US011773630B2

(12) United States Patent
Fontanet

(10) Patent No.: US 11,773,630 B2
(45) Date of Patent: Oct. 3, 2023

(54) EMERGENCY ACCESS DEVICE FOR A VEHICLE OPENING PANEL WITH ELECTRICAL EJECTOR COMPRISING A PERCUSSION MODE

(71) Applicant: Vitesco Technologies GmbH, Regensburg (DE)

(72) Inventor: Alain Fontanet, Toulouse (FR)

(73) Assignee: Vitesco Technologies GmbH

( * ) Notice: Subject to any disclaimer, the term of this patent is extended or adjusted under 35 U.S.C. 154(b) by 0 days.

(21) Appl. No.: 17/763,775

(22) PCT Filed: Dec. 10, 2020

(86) PCT No.: PCT/EP2020/085641
§ 371 (c)(1),
(2) Date: Mar. 25, 2022

(87) PCT Pub. No.: WO2021/116352
PCT Pub. Date: Jun. 17, 2021

(65) Prior Publication Data

US 2022/0333412 A1 Oct. 20, 2022

(30) Foreign Application Priority Data

Dec. 12, 2019 (FR) ..... 1914240

(51) Int. Cl.
*E05B 81/68* (2014.01)
*E05B 81/72* (2014.01)
(Continued)

(52) U.S. Cl.
CPC ..... *E05B 81/77* (2013.01); *E05B 47/0673* (2013.01); *E05B 81/08* (2013.01);
(Continued)

(58) Field of Classification Search
CPC ..... E05B 81/08; E05B 81/90; E05B 47/06; E05B 47/0696; E05B 47/0657;
(Continued)

(56) References Cited

U.S. PATENT DOCUMENTS 3,683,239 A * 8/1972 Sturman ..... H01H 51/2209 361/194
4,167,104 A * 9/1979 Bond ..... E05B 5/003 70/282
(Continued)

FOREIGN PATENT DOCUMENTS

CN 107939186 A 4/2018
DE 102014110091 A1 * 1/2016 ..... E05B 17/0016
(Continued)

OTHER PUBLICATIONS

Espacenet machine translation of DE 102014110091 A1, generated Mar. 7, 2023 (Year: 2023).*
(Continued)

*Primary Examiner* — Kristina R Fulton
*Assistant Examiner* — Emily G. Brown
(74) *Attorney, Agent, or Firm* — RatnerPrestia

(57) ABSTRACT

A vehicle opening panel emergency access device, having: a body; a graspable pull member that is able to move between: a retracted position and a deployed position; a retention pin that is designed to occupy: a locking position and a position for releasing the pull member; an electric ejector designed to control the sliding of the retention pin; a control unit for control according to two modes: an unlocking mode in which the electric ejector drives the retention pin from its locking position to its release position; and a percussion mode in which the electric ejector drives the
(Continued)

retention pin in oscillation between its locking position and an intermediate position between the locking position and the release position.

15 Claims, 2 Drawing Sheets

(51) Int. Cl.
*E05B 81/64* (2014.01)
*E05B 81/08* (2014.01)
*E05B 47/06* (2006.01)
*E05B 81/76* (2014.01)

(52) U.S. Cl.
CPC ..... *E05B 81/64* (2013.01); *E05B 81/68* (2013.01); *E05B 81/72* (2013.01)

(58) Field of Classification Search
CPC ..... E05B 47/0603; E05B 47/0673; E05B 47/0665; E05B 85/10; E05B 85/103; E05B 85/107; H02K 74/033; H02K 33/16; H01H 50/22; B65D 15/16; B65D 15/166
See application file for complete search history.

(56) References Cited

U.S. PATENT DOCUMENTS 4,784,415 A * 11/1988 Malaval ..... E05B 47/00 292/144
5,076,622 A * 12/1991 Detweiler ..... E05B 79/20 292/DIG. 60
10,435,924 B1 10/2019 Salter et al.
2011/0290577 A1* 12/2011 Abidi ..... E05B 47/0657 180/281
2013/0032671 A1* 2/2013 Giles ..... B64C 11/16 244/134 R
2013/0200966 A1* 8/2013 Michaelsen ..... H01F 7/1607 335/261
2014/0000167 A1 1/2014 Patel et al.
2014/0173985 A1* 6/2014 Alsadah ..... E05F 15/40 49/31

FOREIGN PATENT DOCUMENTS

DE 102014110091 A1 1/2016
EP 2904179 B1 8/2015
FR 3081485 A1 11/2019
JP 2018115468 A 7/2018
WO 03064794 A1 8/2003

OTHER PUBLICATIONS

English Translation of Written Opinion for International Application No. PCT/EP2020/085641, dated Feb. 5, 2021, 6 pages.
International Search Report and Written Opinion for International Application No. PCT/EP2020/085641, dated Feb. 5, 2021, with partial English translation, 8 pages.
International Search Report and Written Opinion for International Application No. PCT/EP2020/085641, dated Feb. 5, 2021, 13 pages (French).
Chinese Office Action for Chinese Application No. 202080085584.0, dated Feb. 3, 2023 with translation, 26 pages.

* cited by examiner

EMERGENCY ACCESS DEVICE FOR A VEHICLE OPENING PANEL WITH ELECTRICAL EJECTOR COMPRISING A PERCUSSION MODE

CROSS REFERENCE TO RELATED APPLICATIONS

This application is the U.S. National Phase Application of PCT International Application No. PCT/EP2020/085641, filed Dec. 10, 2020, which claims priority to French Patent Application No. 1914240, filed Dec. 12, 2019, the contents of such applications being incorporated by reference herein.

FIELD OF THE INVENTION

The invention relates to the automotive field and targets an emergency access device associated with a vehicle opening panel.

BACKGROUND OF THE INVENTION

In order to allow access to a motor vehicle, the opening panels of this vehicle (the doors, for example) are equipped with access devices. The most common access devices are handles that are mechanically connected to a lock such that actuation of the handle by the user actuates the lock and allows opening.

Furthermore, more advanced access devices currently exist in which no mechanical connection is required for normal operation of the access device. These devices generally have a sensor for sensing the presence of the user's hand. If the user is authorized to open the vehicle, for example if he or she is carrying a required fob, the vehicle then actuates an electric strike in the lock of the opening panel and thus allows access to the vehicle.

These access devices allow a reduction in mass, bulk and cost as well as greater comfort of use since no physical connection with the lock is necessary in normal operation. However, for safety reasons in particular, these access devices nevertheless require an emergency access device providing a mechanical connection with the lock of the opening panel in the event of an emergency or of an electrical breakdown.

Vehicles equipped with access devices having no mechanical connection, in normal operation, between the handle of an opening panel and its lock are known. These known devices have an emergency access device having a means for actuating the lock, this emergency actuating means being mechanical and retractable.

SUMMARY OF THE INVENTION

An aspect of the invention aims to improve the emergency access devices of the prior art so as to secure the opening, in the event of an emergency, of an opening panel equipped with an access device having no mechanical connection between the handle and the lock of the opening panel.

To this end, an aspect of the invention targets a vehicle opening panel emergency access device, having:

- a body;
- a graspable pull member that is connected to a lock actuator and is able to move between: a retracted position in which the pull member is stowed in the body; and a deployed position in which the pull member protrudes outside the body;

- a retention pin that slides transverse to the pull member and is designed to occupy: a locking position in which it is disposed against the pull member, keeping the pull member in its retracted position; a position for releasing the pull member;
- an electric ejector designed to control the sliding of the retention pin;
- a control unit for the electric ejector that is designed to control the electric ejector according to two modes: an unlocking mode in which the electric ejector drives the retention pin from its locking position to its release position; and a percussion mode in which the electric ejector drives the retention pin in oscillation between its locking position and an intermediate position between the locking position and the release position.

Another subject of the invention targets a vehicle equipped with such an emergency device on an opening panel of the vehicle.

Another subject of the invention targets a method for activating a device as described above, and involving a step of controlling the electric ejector in percussion mode.

The vehicle opening panel emergency access device is intended to intervene only in an emergency or breakdown situation, for example situations requiring the doors to be opened from the outside in the event of an accident, or requiring the doors to be opened despite an electrical failure. An aspect of the invention ensures the effective release of the pull member into its deployed position by virtue of the possibility of implementing the percussion mode in addition to the unlocking mode.

The percussion mode of the electric ejector makes it possible to communicate to the pull member and to the body a vibration that can be adjusted so as to ensure the elimination of any undesirable material that might be present between the pull member and the body. The undesirable materials may be, for example, frozen water, dust, assorted dirt, etc.

When the pull member is in its retracted position, these undesirable materials may infiltrate between the pull member and the body. Since the pull member is indeed intended to be grasped by a user, it is therefore disposed generally at least with one face that is flush with the body, even in the retracted position.

The vehicle opening panel emergency access device is by definition used under exceptional circumstances and the pull member can therefore be kept in its retracted position for long periods (several years, in general). During these long periods, the pull member is in the retracted position in the body without any relative movement between the body and the pull member, such that these undesirable materials can accumulate gradually until they sufficiently foul and fill the clearance present between the pull member and the body (which clearance is necessary for the deployment of the pull member) so as to lock the pull member in the body.

This unwanted locking, that an aspect of the invention makes it possible to prevent or resolve, can lead to a critical situation in which the emergency access device is out of use following locking of the pull member in the body, and the user only perceives this when an emergency situation requires precisely the immediate use of the emergency access device.

The emergency access device and its activation method can be implemented for example as corrective maintenance when it is observed that the pull member does not deploy despite an ejection command, or by controlling the electric ejector systematically first of all in percussion mode then in unlocking mode. The emergency access device and its activation method can also be implemented as preventative maintenance, by activating, for example, the electric ejector in percussion mode regularly, for example every month.

An aspect of the invention guarantees the availability and operational safety of the emergency access device.

The device according to an aspect of the invention may have the following additional features, alone or in combination:

- the retention pin has a ferromagnetic core and the electric ejector is an electromagnet having:
  - a magnetic circuit surrounding the ferromagnetic core of the retention pin;
  - a coil designed to magnetize the magnetic circuit and attract the ferromagnetic core of the retention pin;
- the device has a locking spring that urges the retention pin toward its locking position;
- the device has an ejection spring that urges the pull member toward its deployed position;
- the device has a position sensor for sensing the position of the pull member.

The method according to an aspect of the invention may have the following additional features, alone or in combination:

- the oscillating frequency of the retention pin in percussion mode is situated in the range from 5 to 50 kHz;
- the oscillating frequency of the retention pin in percussion mode is substantially equal to the resonant frequency of the pull member;
- the oscillating frequency of the retention pin in percussion mode is a frequency exhibiting a regular variation in a predetermined frequency range;
- the device involves, after the step of controlling the electric ejector in percussion mode, a step of controlling the electric ejector in unlocking mode;
- the device involves, simultaneously with the step of controlling the electric ejector in percussion mode, a step of controlling the electric ejector in unlocking mode;
- the electric ejector is regularly activated in percussion mode for a predetermined duration, according to a predetermined preventative maintenance interval.

BRIEF DESCRIPTION OF THE DRAWINGS

Other features and advantages of aspects of the invention will become apparent from the following non-limiting description, with reference to the appended drawings, in which:

The FIG.1 and FIG. 2 schematically illustrate an emergency access device 200 according to an aspect of the invention.

DETAILED DESCRIPTION OF THE PREFERRED EMBODIMENTS

Figure 1:
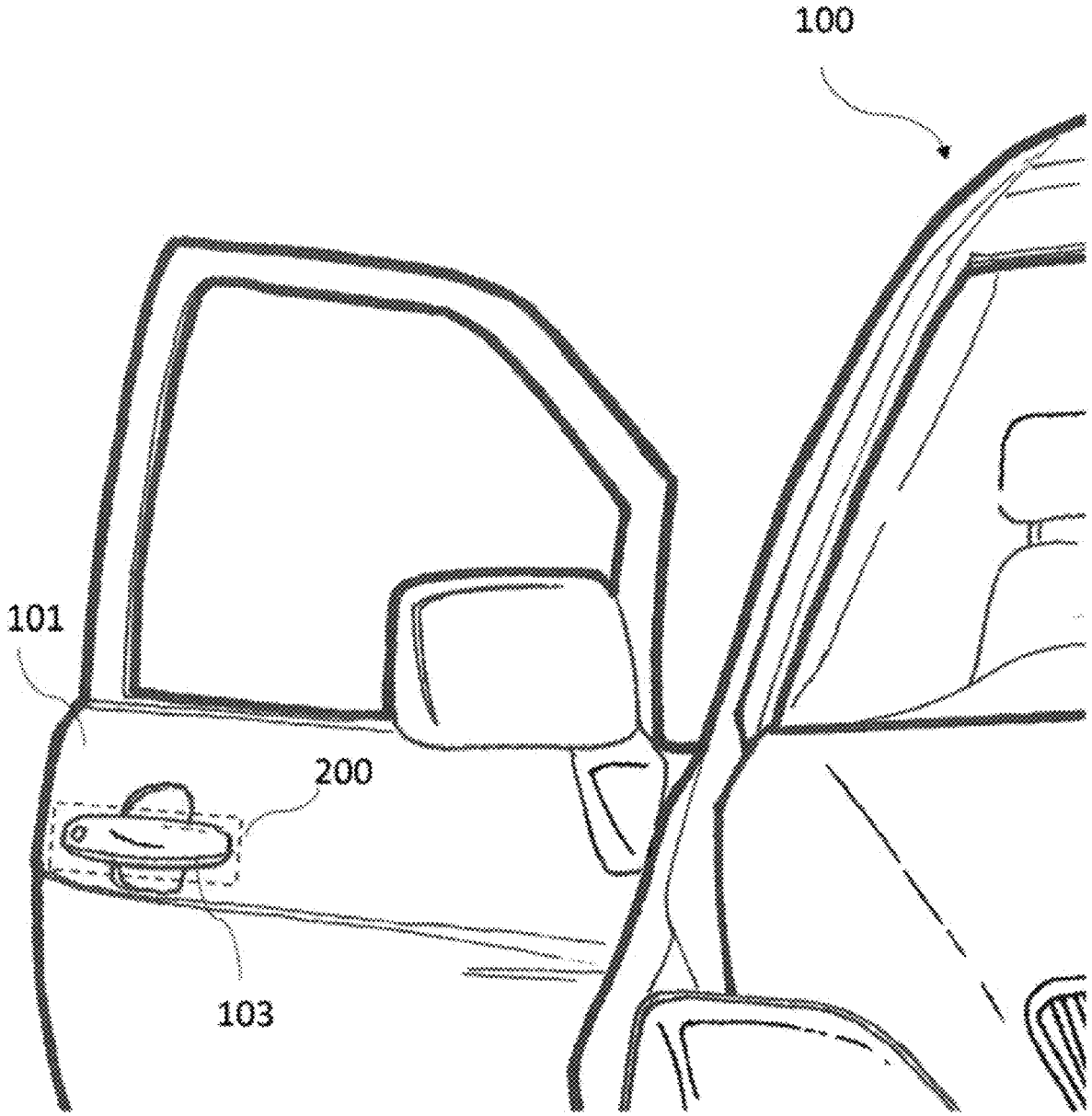
Figure 2:
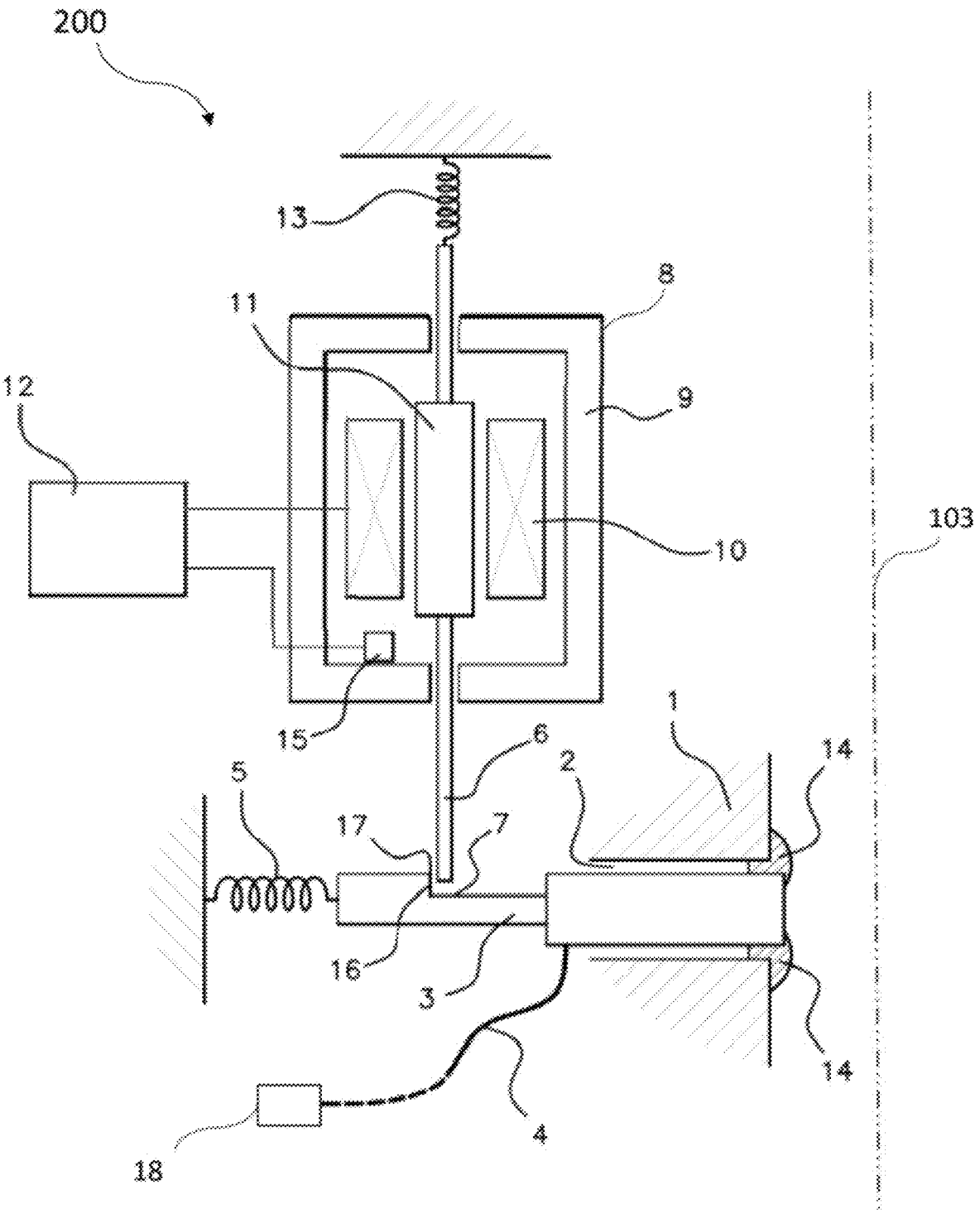

The schematic views in FIG. 1 and FIG. 2 show the main elements of a vehicle 100 with a vehicle opening panel emergency access device 200. This device has a body 1 forming a chassis supporting the various elements of the device. The body 1 is shown partially in FIG. 2. The body 1 has a recess 2, in which a pull member 3 is disposed.

The pull member 3 is a graspable element intended to be grasped by the user in the event of activation of the emergency access device 200. The pull member 3 is connected to a lock actuator that, in the present example, is constituted of a cable 4.

The emergency access device 200 is intended in this example to be installed in a vehicle handle 103 (FIG. 1) that has no mechanical link with the lock, the whole being mounted on a motor vehicle opening panel 101. The cable 4 of the pull member 3 is however mechanically connected to the lock 18 and makes it possible to actuate lock 18 by pulling the pull member 3 when the latter is in the deployed position following activation of the emergency access device 200.

The pull member 3 is thus able to move between a stowed position in the body 1 (position shown in FIG. 2) and a deployed position in which the pull member has come out of the recess 2 and is disposed outside the body 1.

In the retracted position, the pull member 3 is pressed against an ejection spring 5 that urges the pull member 3 toward its deployed position.

The pull member 3 is kept in the retracted position by compressing the ejection spring 5, by virtue of a retention pin 6 engaged in a groove 7. The pin 6 is designed to occupy a locking position in which its end is disposed in the groove 7, against a shoulder 16 of the pull member 3, keeping the pull member 3 in its retracted position (position visible in FIG. 2). The pin 6 is able to slide vertically (in the orientation illustrated in FIG. 2) and is also designed to occupy a position for releasing the pull member, in which the pin 6 is lifted and its end is set back from the groove 7 such that the pull member 3 passes into its deployed position under the action of the ejection spring 5.

The device also has an electric ejector designed to control the sliding of the retention pin 6. The electric ejector is in this case constituted by an electromagnet 8 having: a magnetic circuit 9 that is realized for example by an assembly of laminations; a coil 10 designed to magnetize the magnetic circuit 9; and a ferromagnetic core 11 fastened to the pin 6. The electromagnet 8 is connected to a control unit 12 that controls the supply of power to the coil 10.

Optionally, the electromagnet 8 may have a position sensor 15, which is also connected to the control unit 12, designed to detect the presence of the pin 6 in its locking position or its release position.

The device additionally has a locking spring 13 that urges the pin 6 toward its locking position.

According to this architecture, when the electromagnet 8 is not activated (i.e. when the coil 10 is not supplied with power), and the pull member 3 is in its retracted position, the pin 6 is by default in its locking position under the effect of the urging of the locking spring 13.

The control unit 12 is designed to control the electromagnet 8 according to a first mode called "unlocking" mode, in which the coil 10 is supplied, in the present example, with a direct current so as to attract the core 11 upward (in the position schematically shown in FIG. 2) thus controlling the passage of the pin 6 from its locking position to its release position.

According to an aspect of the invention, the control unit 12 is also designed to control the electromagnet 8 according to a second mode called "percussion" mode, in which the electromagnet 8 drives the pin 6 in oscillation between its locking position and an intermediate position, which is situated between the locking position and the release position.

Specifically, the long periods for which the emergency access device 200 is not in use can result in the accumulation of dust and dirt in the gaps that are present between the pull member 3 and the body 1, or in another context, in winter, ice may be present in these gaps. These undesirable materials are schematically shown by the masses 14 visible in the FIGURE. According to an aspect of the invention, these undesirable materials 14 can be expelled from their location by a vibration of the pull member 3 that is caused during the control of the electromagnet 8 in percussion mode. In order to generate this vibration, the control unit 12, in its percussion mode, supplies the coil 10 with power so as to cause a slight movement upward (in the example orientation in the FIGURE) such that the end of the pin 6 slides upward against the shoulder 16 of the groove 7 but without reaching the edge corner 17, i.e. remaining below the point at which the end of the pin 6 releases the pull member 3 by coming out of the groove 7. This vibration of the pull member 3 is indeed caused while the pull member 3 is kept in its retracted position. The coil 10 will therefore be controlled in oscillation, for example by a squarewave signal or a sinusoidal signal. This control is calibrated for an amplitude of movement of the pin 6 that does not exceed the depth of the groove 7 (the distance between the edge corner 17 and the bottom of the groove 7), in order not to trigger the device by passing the pull member 3 into its deployed position.

The control of the unit 12 in percussion mode thus consists in supplying the coil 10 with power so as to cause this displacement of the pin 6 without releasing the pull member 3, and then ceasing to supply the coil 10 with power, such that, at least under the urging of the locking spring 13, the pin 6 returns to its locking position, striking the bottom of the groove 7 of the pull member 3.

This succession of strikes, according to the oscillating frequency of the pin 6, causes the vibration desired for the pull member 3.

Preferably, the control unit in percussion mode is calibrated for a percussion frequency of the pin 6 on the pull member 3 in a preferred range from 5 to 50 kHz. Preferably, this frequency is from 10 to 20 kHz, and this allows a vibration that is inaudible to the human ear.

According to one embodiment, this frequency is chosen so as to correspond to the resonant frequency of the pull member 3 such that the vibratory movements of the pull member 3 are amplified and are all the more effective for expelling the undesirable materials 14. This resonant frequency is a characteristic linked to the construction of the pull member and of the elements with which it is in contact. This resonant frequency is easily determined empirically or by calculation.

According to another embodiment, the percussion frequency is variable over a predetermined frequency range such that the vibration of the device will necessarily pass through one or more resonant frequencies of the elements constituting it, even if this resonant frequency is not determined in advance.

According to a corrective maintenance embodiment, the emergency access device 200 can be activated by the unit 12 such that, when an ejection command is given to the electromagnet 8 by control in unlocking mode (in response to activation of the device), the unit 12 monitors whether the pull member 3 has indeed passed into deployed mode, by virtue of the sensor 15. If it is observed that the ejection command, which has made the pin 6 pass into its release position, has not resulted in the pull member 3 passing into the deployment position, this means that the pull member 3 is locked by an undesirable material 14. In this case, the unit 12 then activates the electromagnet 8 in percussion mode so as to expel the undesirable material 14 then once again activates the electromagnet 8 in unlocking mode.

According to a corrective or preventative maintenance embodiment, when the device is activated, the unit 12 systematically controls the electromagnet 8 first in percussion mode for a predetermined duration (for example a few seconds) then in unlocking mode.

According to a preventative maintenance embodiment, the unit 12 regularly activates the electromagnet 8 in percussion mode, for example every month for a predetermined duration (for example a few minutes) in order to prevent the accumulation of undesirable material 14.

According to one embodiment, the unlocking and percussion modes can be implemented simultaneously. In this case, the unit 12 controls the movement of the pin 6 in percussion mode, while at the same time gradually increasing the amplitude of movement of the pin 6, until the pin 6 passes over the edge corner 17, thus releasing the pull member 3.

Variant embodiments of the emergency access device may be implemented without departing from the scope of the invention. In particular, the electric ejector can be constituted of an actuator with a different technology, for example by a piezoelectric actuator or by a rotary or linear electric motor, or any other actuator that makes it possible to be controlled according to a percussion mode by the control unit 12.

The embodiments can be combined, for example the corrective maintenance embodiment can be implemented jointly with the preventative maintenance embodiments, thus increasing the operational safety.

The invention claimed is:

1. A vehicle opening panel emergency access device, comprising:

a body;

a graspable pull member that is connected to a lock actuator and is able to move between: a retracted position in which the pull member is stowed in the body; and a deployed position in which the pull member protrudes outside the body;

a retention pin that slides transverse to the pull member and is designed to occupy: a locking position in which it is disposed against the pull member, keeping the pull member in the retracted position, and a release position for releasing the pull member;

an electric ejector designed to control the sliding of the retention pin; and a control unit for the electric ejector that is designed to control the electric ejector according to two modes: an unlocking mode in which the electric ejector drives the retention pin from the locking position to the release position; and a percussion mode in which the electric ejector drives the retention pin in oscillation between the locking position and an intermediate position between the locking position and the release position while increasing an amplitude of a movement of the retention pin until the retention pin is in the release position.

2. The device as claimed in claim 1, wherein the retention pin has a ferromagnetic core and in that the electric ejector is an electromagnet having:

a magnetic circuit surrounding the ferromagnetic core of the retention pin; and a coil designed to magnetize the magnetic circuit and attract the ferromagnetic core of the retention pin.

3. The device as claimed in claim 1, further comprising a locking spring that urges the retention pin toward the locking position.

4. The device as claimed in claim 1, further comprising an ejection spring that urges the pull member toward the deployed position.

5. The device as claimed in claim 1, further comprising a position sensor for sensing whether the retention pin is in the locking position or in the release position.

6. A vehicle having an opening panel equipped with a lock, comprising an emergency access device as claimed in claim 1, the lock actuator of which is connected to said lock.

7. A method for activating a device in accordance with claim 1, the method comprising controlling the electric ejector in the percussion mode.

8. The method as claimed in claim 7, wherein an oscillating frequency of the retention pin in the percussion mode is situated in the range from 5 to 50 kHz.

9. The method as claimed in claim 7, wherein an oscillating frequency of the retention pin in the percussion mode is substantially equal to a resonant frequency of the pull member.

10. The method as claimed in claim 7, wherein an oscillating frequency of the retention pin in the percussion mode is a frequency exhibiting a regular variation in a predetermined frequency range.

11. The method as claimed in claim 7, further comprising, after controlling the electric ejector in the percussion mode, controlling the electric ejector in the unlocking mode.

12. The method as claimed in claim 7, further comprising, simultaneously with controlling the electric ejector in the percussion mode, controlling the electric ejector in the unlocking mode.

13. The method as claimed in claim 7, wherein the electric ejector is regularly activated in the percussion mode for a predetermined duration, according to a predetermined preventative maintenance interval.

14. A method for activating a vehicle opening panel emergency access device comprising a body, a graspable pull member connected to a lock actuator and configured to move between a retracted position in which the pull member is stowed in the body and a deployed position in which the pull member protrudes outside the body, a retention pin that slides transverse to the pull member and is designed to occupy a locking position in which the retention pin is disposed against the pull member, keeping the pull member in the retracted position, and a release position for releasing the pull member, an electric ejector designed to control the sliding of the retention pin, and a control unit designed to control the electric ejector, the method comprising:

controlling the electric ejector according to two modes: an unlocking mode in which the electric ejector drives the retention pin from the locking position to the release position; and a percussion mode in which the electric ejector drives the retention pin in oscillation between the locking position and an intermediate position between the locking position and the release position while increasing an amplitude of a movement of the retention pin until the retention pin is in the release position; and simultaneously with controlling the electric ejector in the percussion mode, controlling the electric ejector in the unlocking mode, wherein during the simultaneous controlling of the electric ejector in the percussion mode and in the unlocking mode, the control unit controls a movement of the retention pin in the percussion mode while gradually increasing an amplitude of the movement of the retention pin until the retention pin is in the release position.

15. A method for activating a vehicle opening panel emergency access device comprising a body, a graspable pull member connected to a lock actuator, a retention pin, an electric ejector designed to control the sliding of the retention pin, and a control unit, the method comprising:

moving the pull member between a retracted position in which the pull member is stowed in the body and a deployed position in which the pull member protrudes outside the body;

sliding the retention pin transverse to the pull member from a locking position in which the retention pin is disposed against the pull member, keeping the pull member in a retracted position, to a release position for releasing the pull member;

controlling the electric ejector, by the control unit, according to two modes:

an unlocking mode in which the electric ejector drives the retention pin from the locking position to the release position; and a percussion mode in which the electric ejector drives the retention pin in oscillation between the locking position and an intermediate position between the locking position and the release position; and simultaneously with controlling the electric ejector in the percussion mode, controlling the electric ejector in the unlocking mode.

* * * * *